US011230030B2

(12) United States Patent
Thuemler

(10) Patent No.: US 11,230,030 B2
(45) Date of Patent: Jan. 25, 2022

(54) PHASE SHIFTING DEBARKING APPARATUS, SYSTEM AND METHOD

(71) Applicant: BID GROUP TECHNOLOGIES LTD., Prince George (CA)

(72) Inventor: Nicholas Jaccob Thuemler, Corning, CA (US)

(73) Assignee: BID GROUP TECHNOLOGIES LTD, Prince George (CA)

( * ) Notice: Subject to any disclaimer, the term of this patent is extended or adjusted under 35 U.S.C. 154(b) by 429 days.

(21) Appl. No.: 16/007,482

(22) Filed: Jun. 13, 2018

(65) Prior Publication Data

US 2019/0016010 A1 Jan. 17, 2019

Related U.S. Application Data

(60) Provisional application No. 62/518,852, filed on Jun. 13, 2017.

(51) Int. Cl.
*B27L 1/08* (2006.01)
*B27L 1/05* (2006.01)

(52) U.S. Cl.
CPC .. *B27L 1/08* (2013.01); *B27L 1/05* (2013.01)

(58) Field of Classification Search
CPC ..... B27L 1/00; B27L 1/08; B27L 1/10
See application file for complete search history.

(56) References Cited

U.S. PATENT DOCUMENTS 3,196,912 A * 7/1965 Brundell ..... B27L 1/08 144/208.3
4,122,877 A * 10/1978 Smith ..... B23Q 1/0018 144/208.8
2003/0226617 A1* 12/2003 Choquette ..... B27L 1/00 144/4
2012/0305137 A1* 12/2012 Cholewczynski ..... B27L 1/08 144/208.8

FOREIGN PATENT DOCUMENTS

CA 2516496 A1 * 3/2007 ..... B27L 1/08
DE 2240921 A1 * 3/1974 ..... B27L 1/08

* cited by examiner

*Primary Examiner* — Teresa M Ekiert
*Assistant Examiner* — Sarkis A Aktavoukian
(74) *Attorney, Agent, or Firm* — Brouillette Legal Inc.; Robert Brouillette

(57) ABSTRACT

The present invention relates to a phase shifting debarker. The shifting debarker generally comprises a phase shifting mechanism being powered by a main motor and being connected to an operative assembly by the mean of timing belts. The main motor is being configured to control, by the mean of a belt, the movement of the phase shifting mechanism which is being adapted to control the movement of the operative assembly by the mean of the timing belts. The operative assembly generally comprises an actuator ring and a main ring. The activation of the shifting mechanism creates a shift phase between the actuator ring and the main ring while rotating at the same speed.

22 Claims, 17 Drawing Sheets

PHASE SHIFTING DEBARKING APPARATUS, SYSTEM AND METHOD

CROSS-REFERENCE TO RELATED APPLICATIONS

The present patent application claims the benefits of priority of U.S. Provisional Patent Application No. 62/518,852, entitled "PHASE SHIFTING DEBARKING APPARATUS, SYSTEM AND METHOD", and filed at the United States Patent and Trademark Office on Jun. 13, 2017, the content of which is incorporated herein by reference.

FIELD OF THE INVENTION

The present invention generally relates to apparatuses, systems and methods for debarking logs and/or trunks. More particularly, the present invention relates to phase shifting debarking apparatuses, system and debarking methods.

BACKGROUND OF THE INVENTION

Conventionally, various apparatuses and systems were designed to remove bark from logs in sawmills. These apparatuses and systems are configured to use tool arms equally spaced around the longitudinal axis of a log. The tool arms apply a pressure to the logs to remove the bark through cambium shear. Most of the systems use air bags, air cylinders or springs to apply such a pressure. The pressure of these systems should be continuously changed and controlled through at least one air seal. However, the use of air seals limits the rotation speed of tool arms around the log, which, consequently, limits the line speed of the debarking systems.

Furthermore, the conventional debarking systems, such as the debarkers disclosed in U.S. Pat. No. 4,122,877, in U.S. Pat. No. 4,844,201 and in U.S. publication of the patent application No. 2012/0305137, are configured in a way that the tool arms are continuously exposed to mechanical impacts or shocks once a log is introduced to the debarking system. The tool arms are, further, exposed to the beating effects once they are not running correctly over the outer surface of the log. The mechanical impact shocks and the beating effects do not only damage the tool arms but also cause excessive fiber damage for the logs or an improper debarking on the first few feet of the logs.

Despite the previous use of different debarking systems, there is still a need to improve the speed of the process of debarking logs and to avoid continuous control of the debarking process pressure by the use of pre-charged air components, such as pre-charged air springs.

SUMMARY OF THE INVENTION

The shortcomings of the prior art are generally mitigated by providing a system and method for debarking logs using a phase shifting debarker.

The phase shifting debarking apparatus, system and method according to the present invention aims at improving the rotation speed of tool arms around the log to be debarked and thus improving the line speed of the debarking systems.

In another aspect of the invention, the phase shifting debarking apparatus, system and method according to the present invention aims at offering a possible pre-setting of the tool arms depending on the diameter of the log to be debarked.

Besides the common debarking systems, such as the system previously disclosed in US publication of the patent application No. 2012/0305137 A1, the present invention aims at avoiding impact shocks and beating effects that may damage the tool arms and may cause excessive fiber damage for the logs.

Finally, the present invention aims at offering a pre-set pressure control mechanism that does not need a continuous control of the pressure during the debarking process.

In one aspect of the invention, a phase shift log debarker is provided. The debarker comprises an operative assembly comprising an aperture adapted to receive a log, two rings, a rotation member adapted to rotate each ring about a common axis and tool arms adapted to be move in and out of the aperture. The debarker further comprises a drive system, such as a driver, for rotating the two rings and a phase shift mechanism, such as a phase shifter, adapted to vary the rotation speed of a first of the two rings with regard to the other ring wherein the variation of the rotation speed of the first ring triggers the movement of the tool arms.

The debarker may further comprise two endless members driven by the drive system, the first and second endless members each driving one of the rings. The first and second endless members may respectively surround the periphery of the first and second rings. The first and second endless members may further be belts or bands. In certain embodiments, the periphery of the rings may be toothed and the first and second endless members may be toothed to engage with the toothed periphery of the rings.

The phase shifting mechanism may be adapted to reverse the direction of rotation of the second endless member, the friction created by the reversed direction of the second endless member varying the speed of the first ring. The phase shifting mechanism may further comprise two wheels driving the drive system, each wheel driving a ring with the first and second endless members, the phase shifting mechanism may be adapted to reverse the direction of rotation or to stop the rotation of the wheel driving the first ring. The phase shifting mechanism may further comprise a servomotor configured to reverse the direction of rotation or to stop the rotation of the second endless member.

A second of the ring may further comprise a plurality of pressure control mechanisms, each pressure mechanism being mounted to each tool arm, the pressure control mechanism being adapted to move with regard to the first ring. The pressure control mechanisms may be equally and radially spaced apart within the first ring.

The first ring may further comprise a guiding aperture for each pressure control mechanism, each guiding aperture being adapted to guide the pressure control mechanism along a predetermined radial path. Each pressure control mechanism may be mounted to an air spring filled with a predetermined volume of gas, the air-spring being adapted to maintain pressure on the tool arms. The air-spring may be compressed when a diameter of a log to be debarked is higher than the diameter of a passage formed by the tool arms in the aperture. The force applied by the tool arms on the periphery of the log to be debarked may be function of the compression level of the air spring.

The first ring may further comprise a guiding member for each pressure control mechanism, each guiding member being pivotally and slidably mounted to the first ring and being mounted to a pressure control mechanism. The first ring may be configured to rotate with respect to the second ring about 30 degrees.

In another aspect of the invention, a phase shift mechanism for a log debarker is provided. The phase shift mechanism comprises two idling wheels pivotally mounted on a shaft, the two idling wheels being driven by a drive system, a ball screw comprising a ball nut, the ball screw being substantially parallel to the shaft and being driven by a servomotor and a cross-member, the cross-member being slidably and pivotally mounted to the ball screw at a first end and pivotally mounted to the shaft at a second end; the cross-member being adapted to slide along the ball screw when the ball nut rotates. The servomotor is configured to momentarily reverse the rotation direction of the ball screw and a first of the two idling wheels comprises an engaging portion adapted to rotate in one direction when the cross-member moves towards the change direction the first idling wheel and to rotate in another direction when the cross-member moves away from the first idling wheel.

The engaging portion may be hollow and may comprise a female portion, the second end of the cross-member being a male portion adapted to mate with the female portion. The female and male portion may be threaded with compatible helical splines or the two idling wheels may be sprockets.

In yet another aspect of the invention, a method for debarking a log is provided. The method comprises measuring the diameter of a portion of the log to be debarked, automatically moving tool arms of an operative assembly to form a passage having a diameter being a function of the measured diameter of the log, inserting the measured portion of the log in the passage and rotating the tools arms around the log.

The method may further comprises varying rotation speed between two rotative rings of the operative assembly to trigger the movement of the tools arms. The method may further comprise calculating the force applied by the tool arms on the log as a function of the compression of one or more air bag being compressed when speed between the two rotative rings is varied.

The method may further comprises activating a phase shift mechanism to vary the rotative speed of a first of the two rotative rings. The activation of the phase shift mechanism may reverse the rotation direction of an endless driving member driving the first rotative ring to vary the speed of the first rotative ring. The reversing of the rotation direction of the endless driving member may be controlled by a servomotor.

The method further may further comprise scanning a portion of the log to be debarked to measure the diameter of the portion. The scanning may be executed at a predetermined frequency.

The method may further comprise automatically retracting the tool arms of the operative assembly to increase the diameter of the passage or automatically closing the tool arms of the operative assembly to reduce the diameter of the passage. The method may further comprise automatically and completely retracting the tool arms of the operative assembly when insertion of the log stops.

Other and further aspects and advantages of the present invention will be obvious upon an understanding of the illustrative embodiments about to be described or will be indicated in the appended claims, and various advantages not referred to herein will occur to one skilled in the art upon employment of the invention in practice.

BRIEF DESCRIPTION OF THE DRAWINGS

The above and other aspects, features and advantages of the invention will become more readily apparent from the following description, reference being made to the accompanying drawings in which.

DETAILED DESCRIPTION OF THE PREFERRED EMBODIMENT

A novel phase shifting debarking apparatus, system and method will be described hereinafter. Although the invention is described in terms of specific illustrative embodiments, it is to be understood that the embodiments described herein are by way of example only and that the scope of the invention is not intended to be limited thereby.

A phase shift debarker is disclosed. The phase shift debarker is generally adapted to alternately or sequentially provide change in speed to a belt or a sprocket. In some embodiments, the system comprises two belt, each belt driving a rotating ring. The speed of one belt remains constant while the speed of the second belt is varied. The change in speed of the belt activates movement of one or more tool arms mounted to one of the rings. More specifically, when the speed of the belts is different, the tool arms are adapted to either move toward the center of the operative assembly (open configuration) or retract or move toward the periphery of the operative assembly (close configuration). Understandably, the trunk to be debarked is typically inserted within the operative assembly when in open configuration or when the operative assembly is at the same diameter as the trunk and the trunk is moved while the tool arms are moved closer to the trunk to remove bark.

Figure 1:
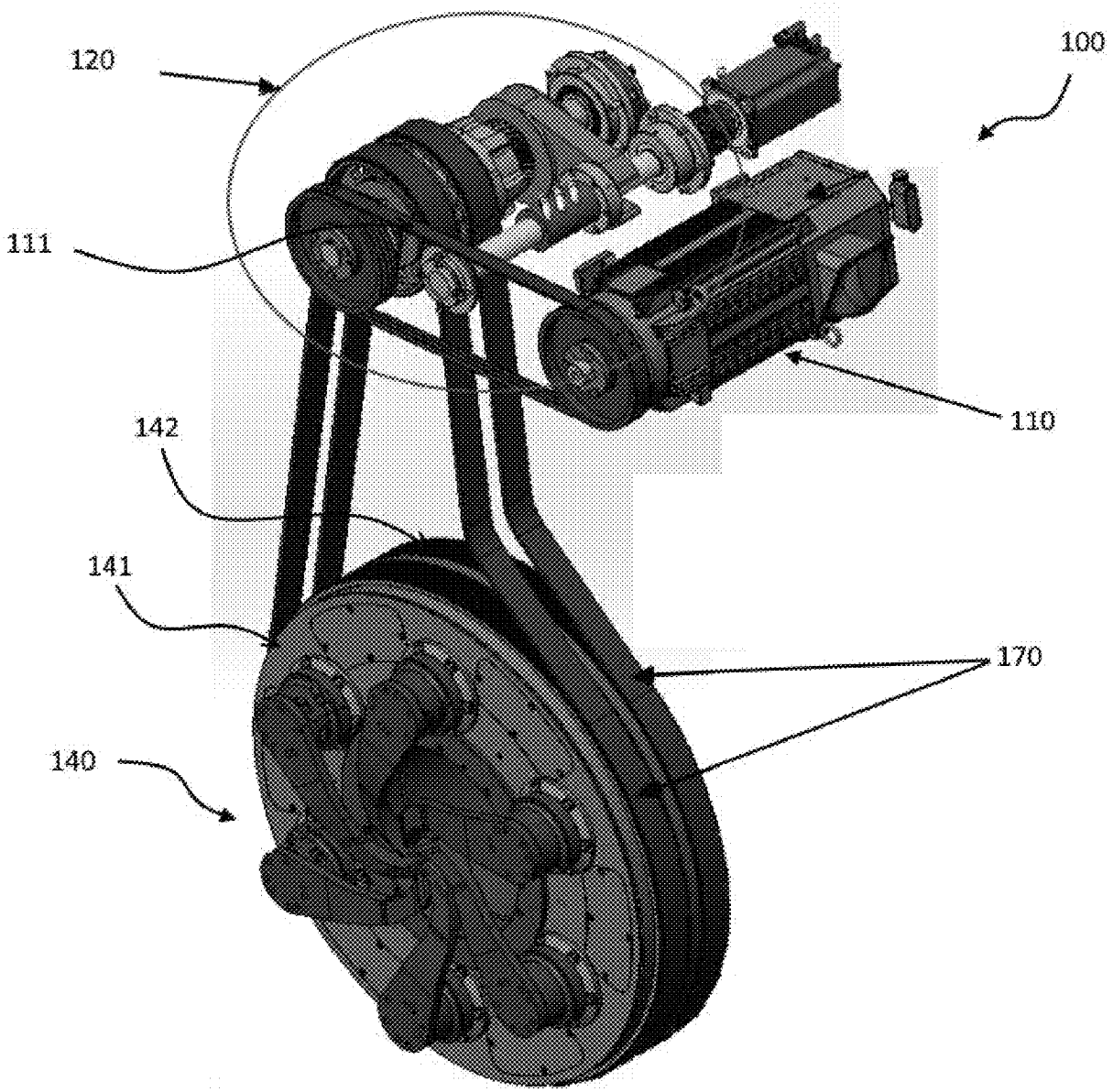
FIG. 1 is a perspective view of a phase shift debarker in accordance with the principles of the present invention.

Referring to FIG. 1, a first embodiment of a phase shift debarker 100 is illustrated. The phase shift debarker 100 comprises a phase shifting mechanism 120 powered by a main motor 110 and connected to an operative assembly 140 by the mean of timing belts 170. The main motor 110 is configured to control, by the mean of a belt 111, the movement of the phase shifting mechanism 120 which is adapted to control the movement of the operative assembly 140 by the mean of the timing belts 170.

Figure 2:
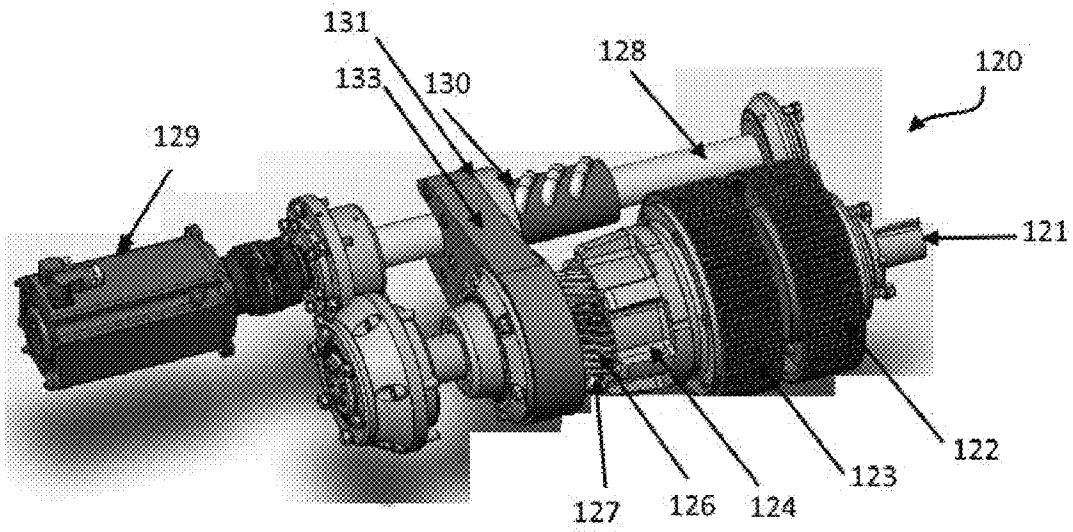
FIG. 2 is a perspective view of a phase shifting mechanism of the phase shift debarker of FIG. 1 in accordance with the principles of the present invention.
Figure 3:
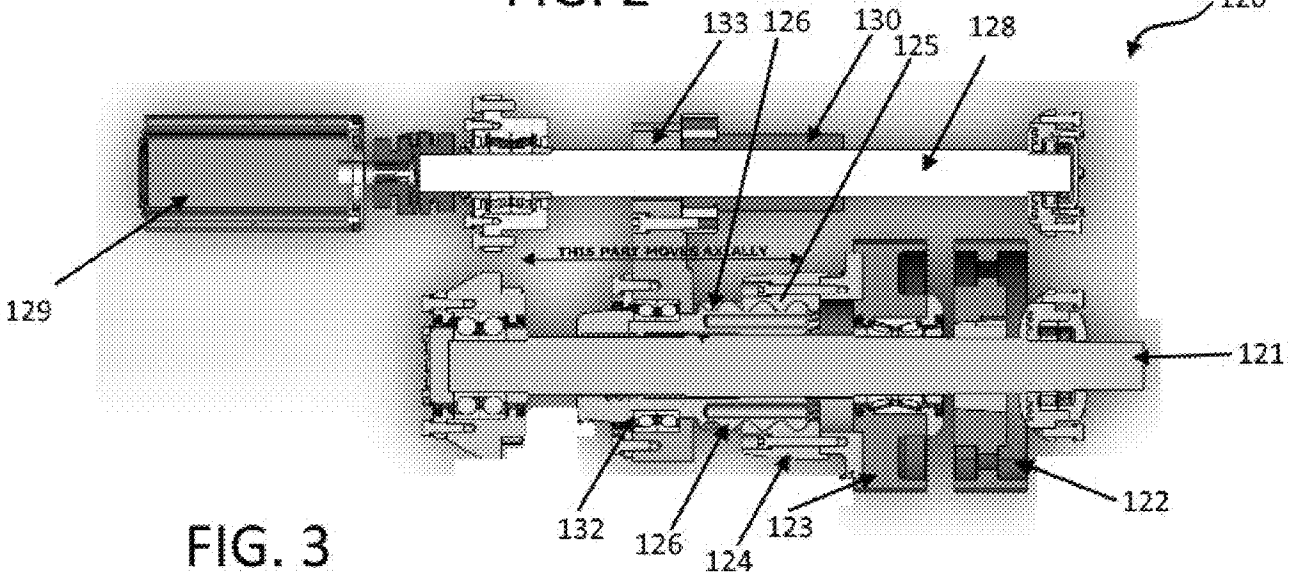
FIG. 3 is a sectional top view of the phase shifting mechanism of FIG. 2.
Figure 5:
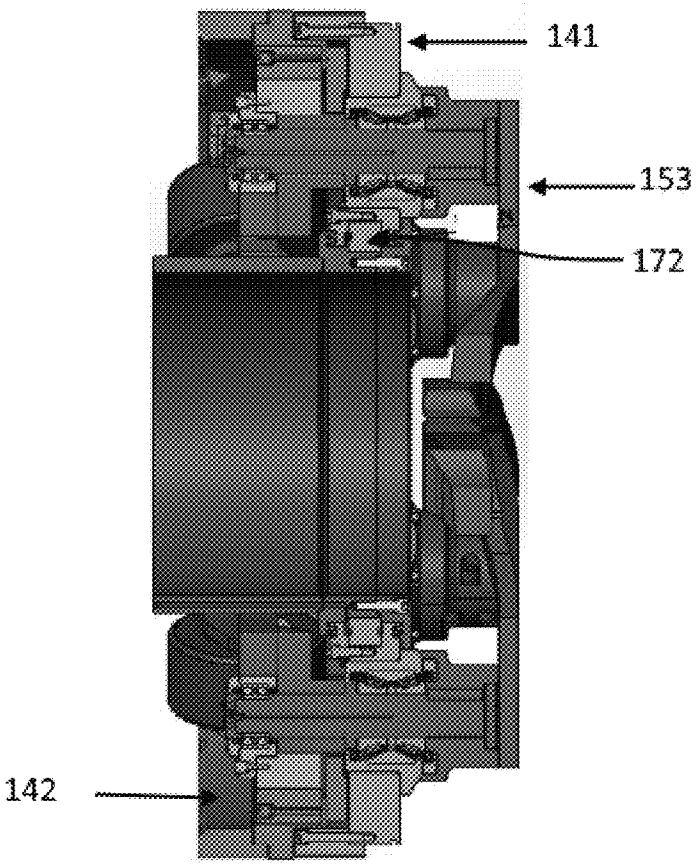
FIG. 5 is a sectional side view of the operative assembly of FIG. 4.
Figure 4:
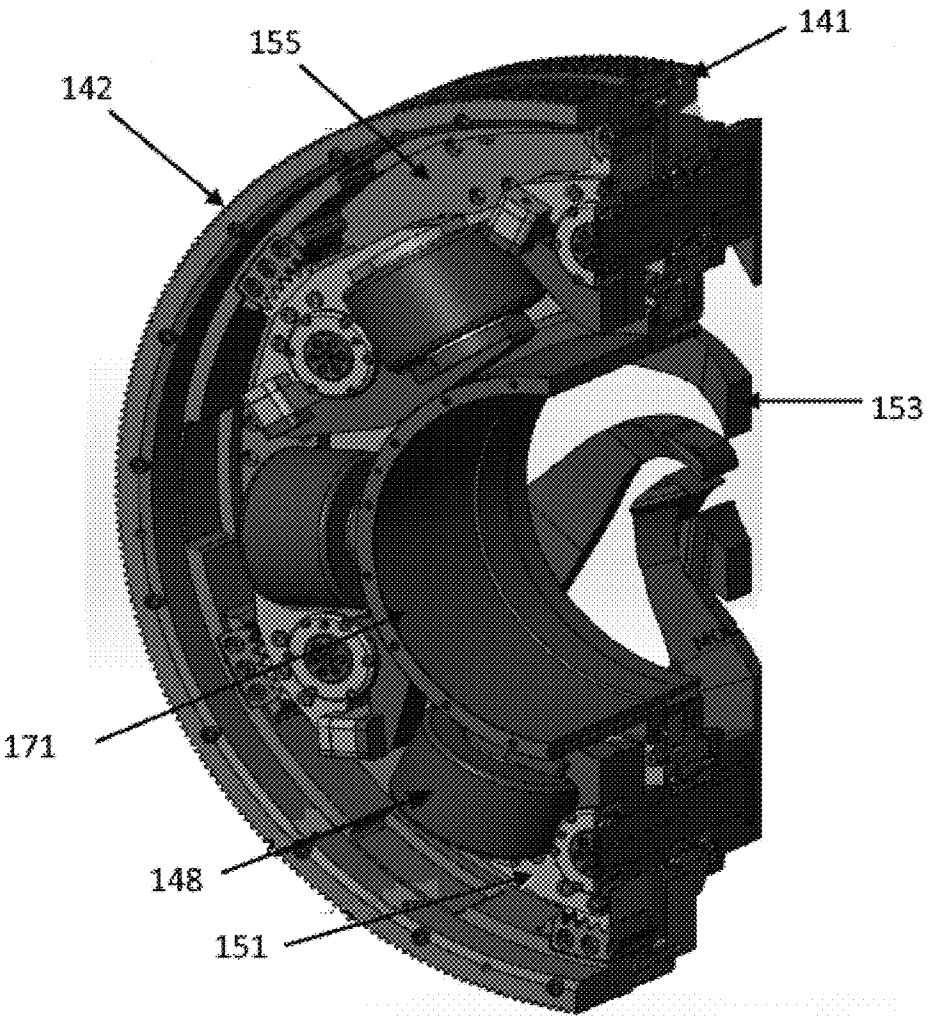
FIG. 4 is a sectional perspective view of an operative assembly of the phase shift debarker of FIG. 1 in accordance with the principles of the present invention.
Figure 6:
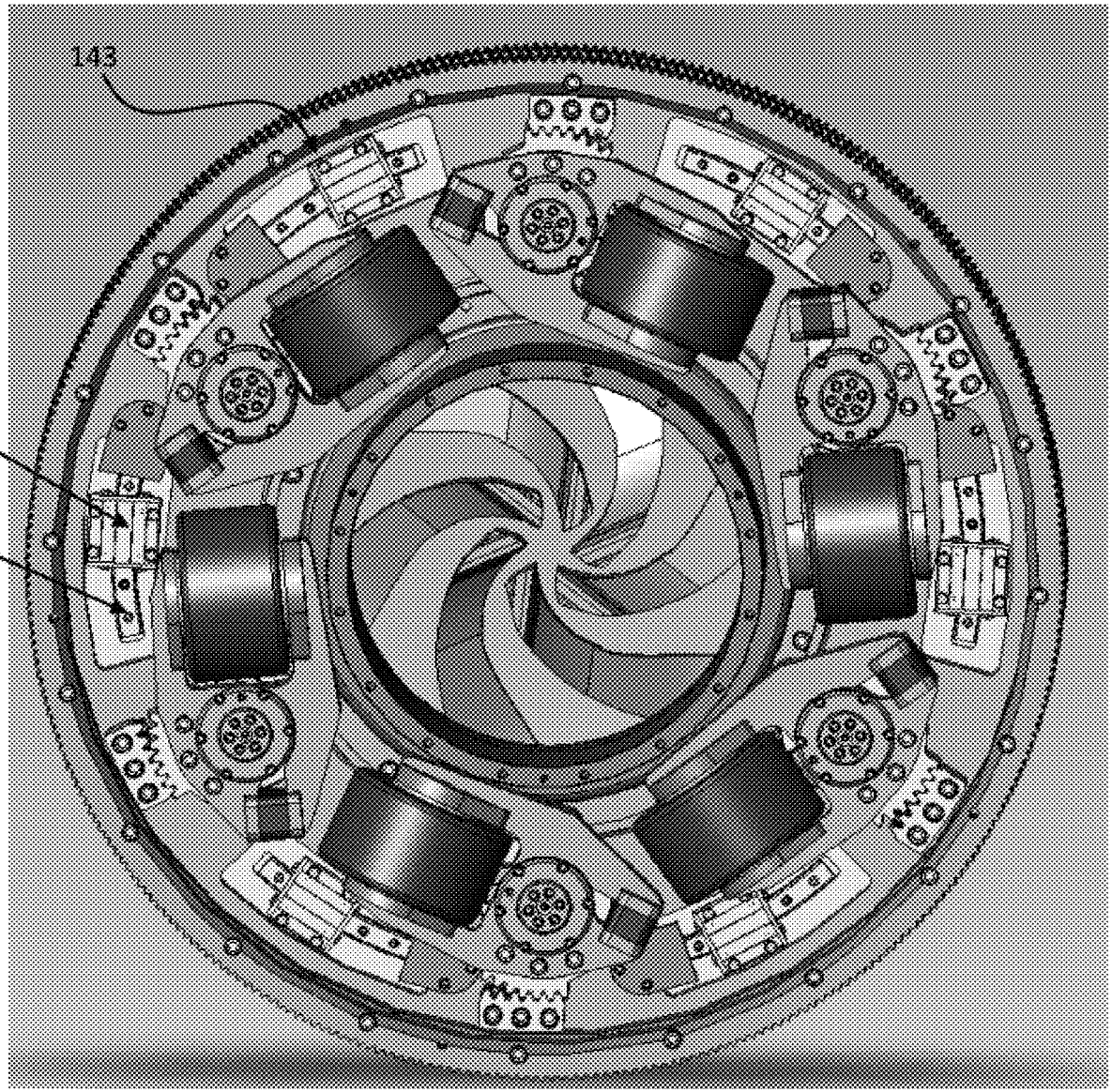
FIG. 6 is an inner front view of the operative assembly of FIG. 4 showing a mean for assembling two rings of the operative assembly.

Referring now to FIGS. 2 and 3, the phase shifting mechanism 120 is illustrated. The phase shifting mechanism 120 comprises a first main shaft 121 on which is mounted a main ring sprocket 122 and an actuator ring sprocket 123 in a conventional bushing type of configuration. The actuator ring sprocket 123 is attached at one side to a female component 124 having an inner surface defining helical splines 125. The female component 124 is further adapted to receive a male component 126 configured to be slidably mounted to the main shaft 121 and having an outer surface defining helical splines 127 configured in a way to mate with the helical splines 125 once the male component 126 is slid inside the female component 124 and the outer surface of the male component engages the inner surface of the female component.

Still referring to FIGS. 2 and 3, the phase shifting mechanism 120 further comprises a movement inducer element, such as a ball screw 128 mounted to a servomotor 129 and a ball nut 130 mounted on the ball screw 128. One extremity 131 of the ball nut 130 is rigidly attached to one extremity 132 of the male component 126 by the mean of a cross member 133.

Still referring to FIG. 3, the activation of the servomotor 129 drives the rotation of the ball screw 128 which actuates a sliding movement of the ball nut 130 over the surface of the ball screw 128. Understandably, as being rigidly attached to the ball nut 130, the sliding movement of the ball nut 130 actuates a sliding movement of the male component 126 over the surface of the main shaft 121 in a way that the helical splines 127 of the male component 126 engages the helical splines 125 of the female component 124 which results in the rotation of the actuator ring sprocket 123 with respect to the main shaft 121. In such a configuration, the actuator ring sprocket 123 and the main ring sprocket 122 are both mounted to the main shaft 121 in a conventional bushing configuration et are configured to rotate at the same speed with a shift phase.

Understandably, once the servomotor 129 is inoperative, the actuator ring sprocket 123 and the main ring sprocket 122 are both mounted to the main shaft 121 in a conventional bushing configuration and are configured to rotate at the same speed in a synchronized configuration.

Referring now to FIGS. 1 and 4-6, the main ring sprocket 122 and the actuator ring sprocket 123 are both connected, respectively, to a main ring 141 and an actuator ring 142 of the operative assembly 140 by the mean of two timing belts 170. The main ring 141 is rotatably mounted to a mounting ring 171 of a bearing by the mean of a main ring bearing 172. The actuator ring 142 is mounted to the main ring 141 by the mean of guiding members 143 defining a support base 149 configured to slidably rotate inside curved rails 144 of the main ring 141.

Such a configuration allows the actuator ring 142 to possibly rotate with respect to the main ring 141.

In some embodiments, the actuator ring 142 is configured to rotate with respect to the main ring 141 of approximately 30 degrees.

Figure 7:
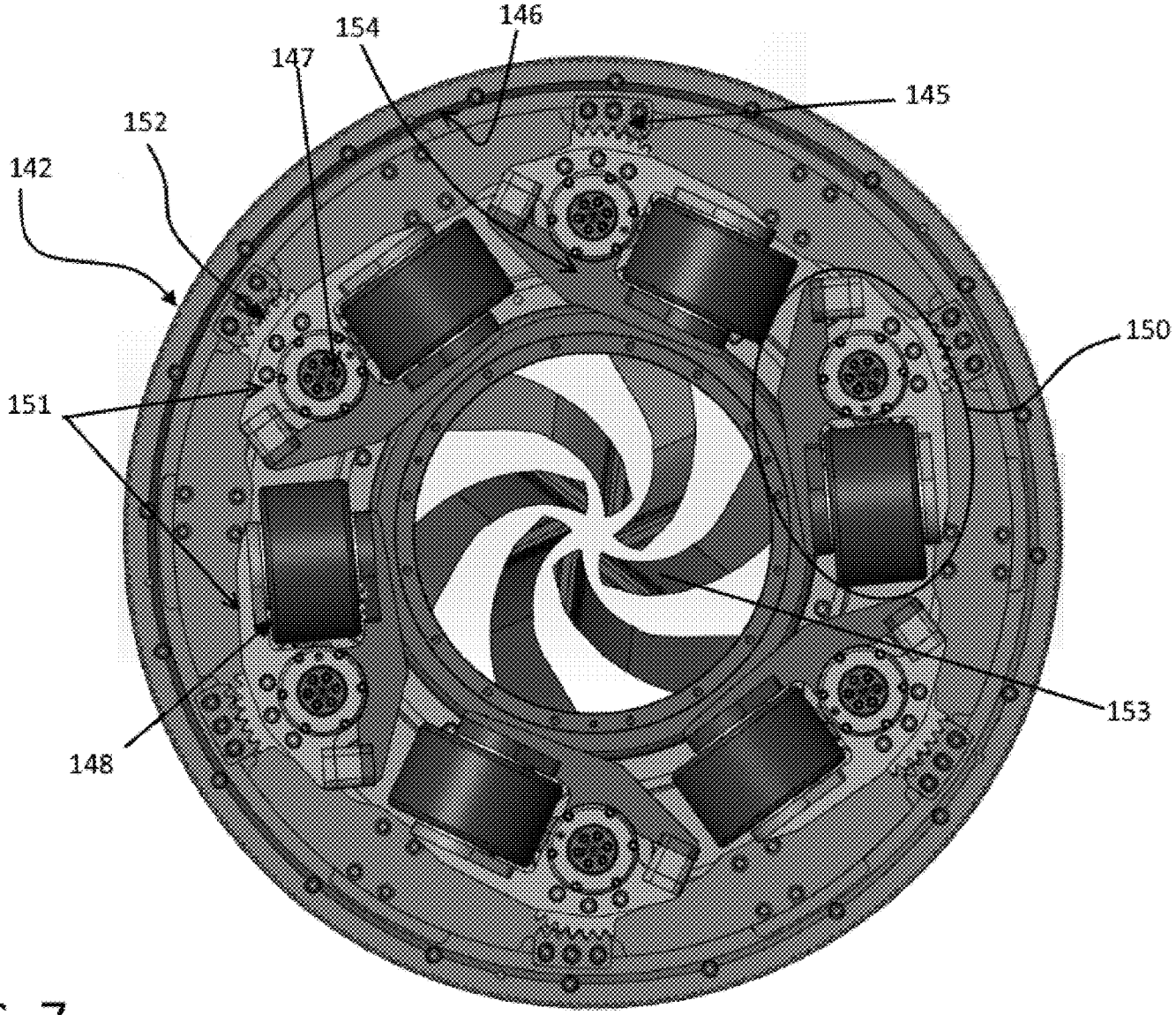
FIG. 7 is a front view of the operative assembly of FIG. 4 showing a pressure control mechanism for opening and closing arm tools of the phase shift debarker in accordance with the principles of the present invention.
Figure 8:
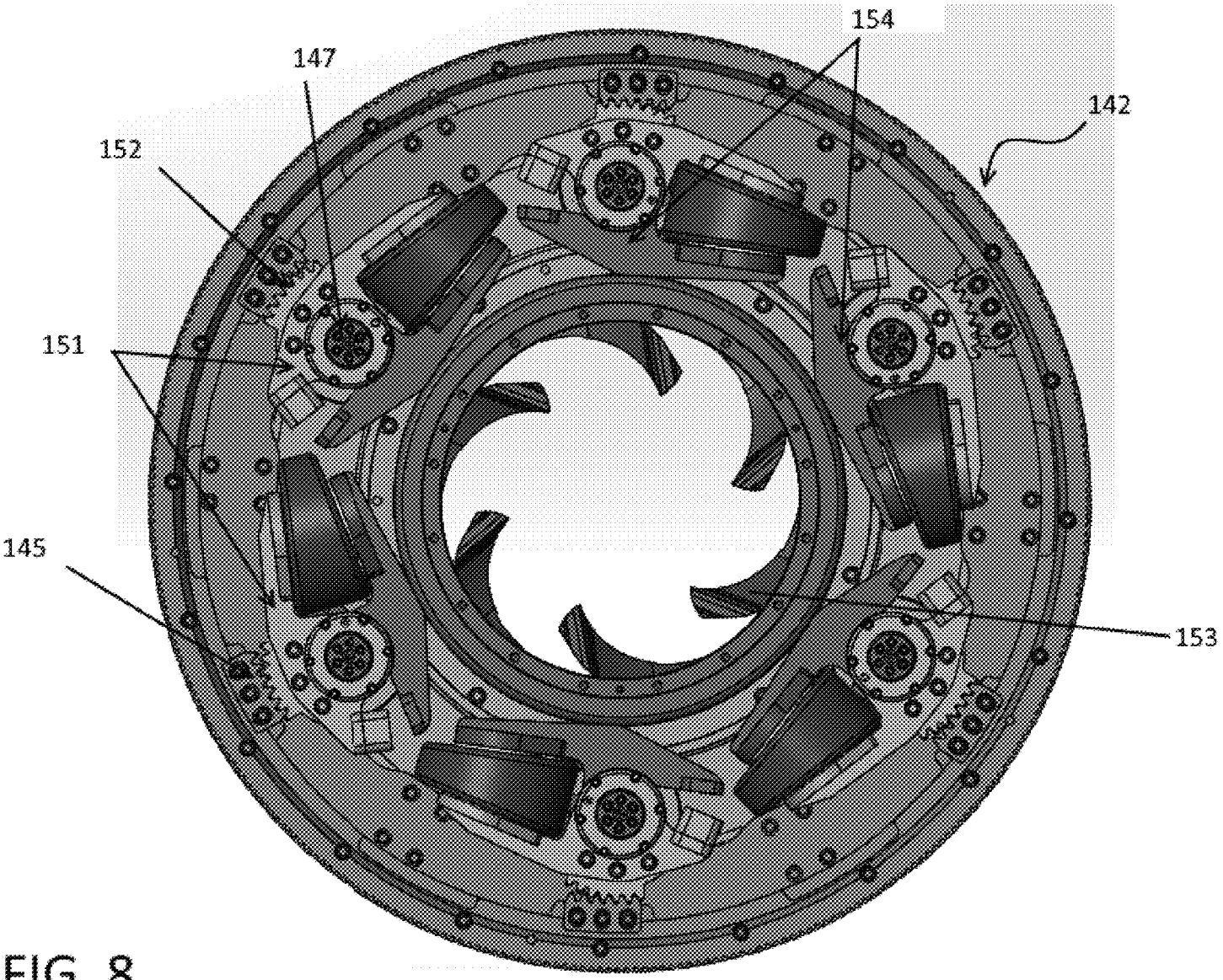
FIG. 8 is a front view of the operative assembly of FIG. 4 showing the pressure control mechanism in a compressed position for opening the arm tools of the phase shift debarker in accordance with the principles of the present invention.

Referring further to FIGS. 7 and 8, in at least one embodiment, the actuator ring 142 further comprises gear segments 145 equally spaced over the circumference of the inner surface 146 of the actuator ring 142. The gear segments 145 are adapted to mate and engage gear segments 152 of tension set arms 151 being spaced equally similar to the gear segments 145 of the actuator ring 142. Each tension set arm 151 is comprised in a pressure control mechanism 150.

Still referring to FIGS. 7 and 8, each control pressure mechanism 150 is pivotally mounted to the main ring 141 and is mounted to the actuator ring 142 by the mean of a tool arm shaft 147. Each pressure control mechanism 150 comprises a pre-charged air spring 148 held between a tension set arm 151 and a swing arm 154 linked to a tool arm 153. The tension set arm 151 is further configured to pivot into an opening 155 of the actuator ring 142.

Understandably, both the main ring 141 and the actuator ring 142 are controlled by the same main motor 110 which controls the rotation of the first main shaft 121 on which are mounted both the main ring sprocket 122 and the actuator ring sprocket 123. The rotation of the main shaft 121 induces the rotation of both sprockets 122 and 123 which induces the rotation of both rings 141 and 142.

Understandably, when the servomotor 129 remains inoperative, the actuator ring sprocket 123 and the main ring sprocket 122 are configured to rotate at the same speed in a synchronized configuration. Consequently, both the main ring 141 and the actuator ring 142 are rotating at the same speed in a synchronized configuration.

Understandably, when the servomotor 129 is operative, the actuator ring sprocket 123 and the main ring sprocket 122 are configured to rotate at the same speed with a shift phase. The shift phase between both sprockets 122 and 123 actuates a slidable rotation movement of the guiding members 143 of the actuator ring over the curved rails 144 of the main ring 141. This slidable rotation movement actuates a rotation of the actuator ring 142 with respect to the main ring 141 which induces the rotation of the pressure control mechanisms 150 with respect to the main ring 141 by the mean of the gear segments 145 and 152.

Figure 9:
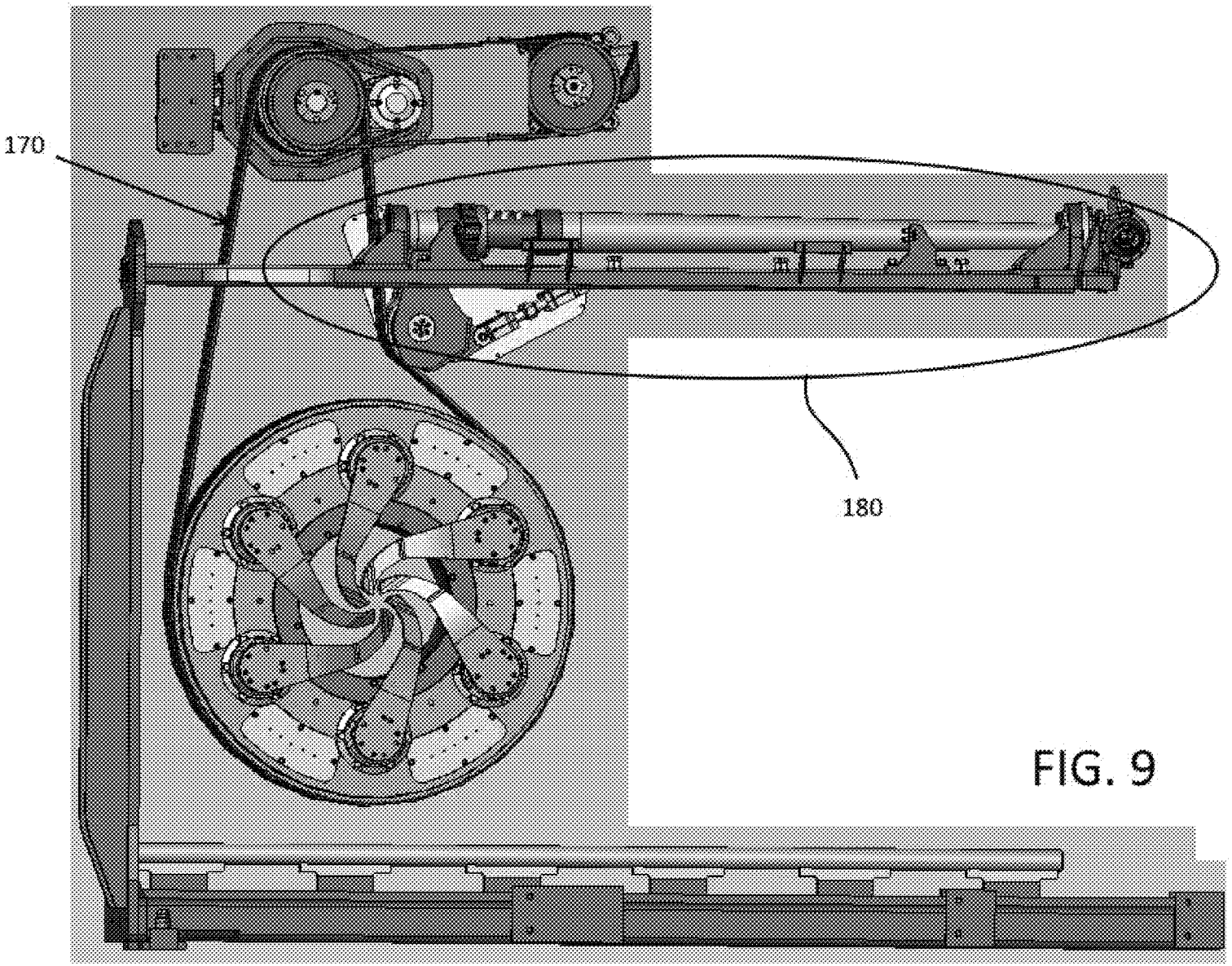
FIG. 9 is a front view of the phase shift debarker of FIG. 1 comprising a belt tension control mechanism in accordance with the principles of the present invention.

Preferably, the phase shift debarker 100 may optionally comprise a maintenance system 180 to release tension on the belt to easily remove, replace or install the operative assembly 140. (See FIG. 9).

Figure 10:
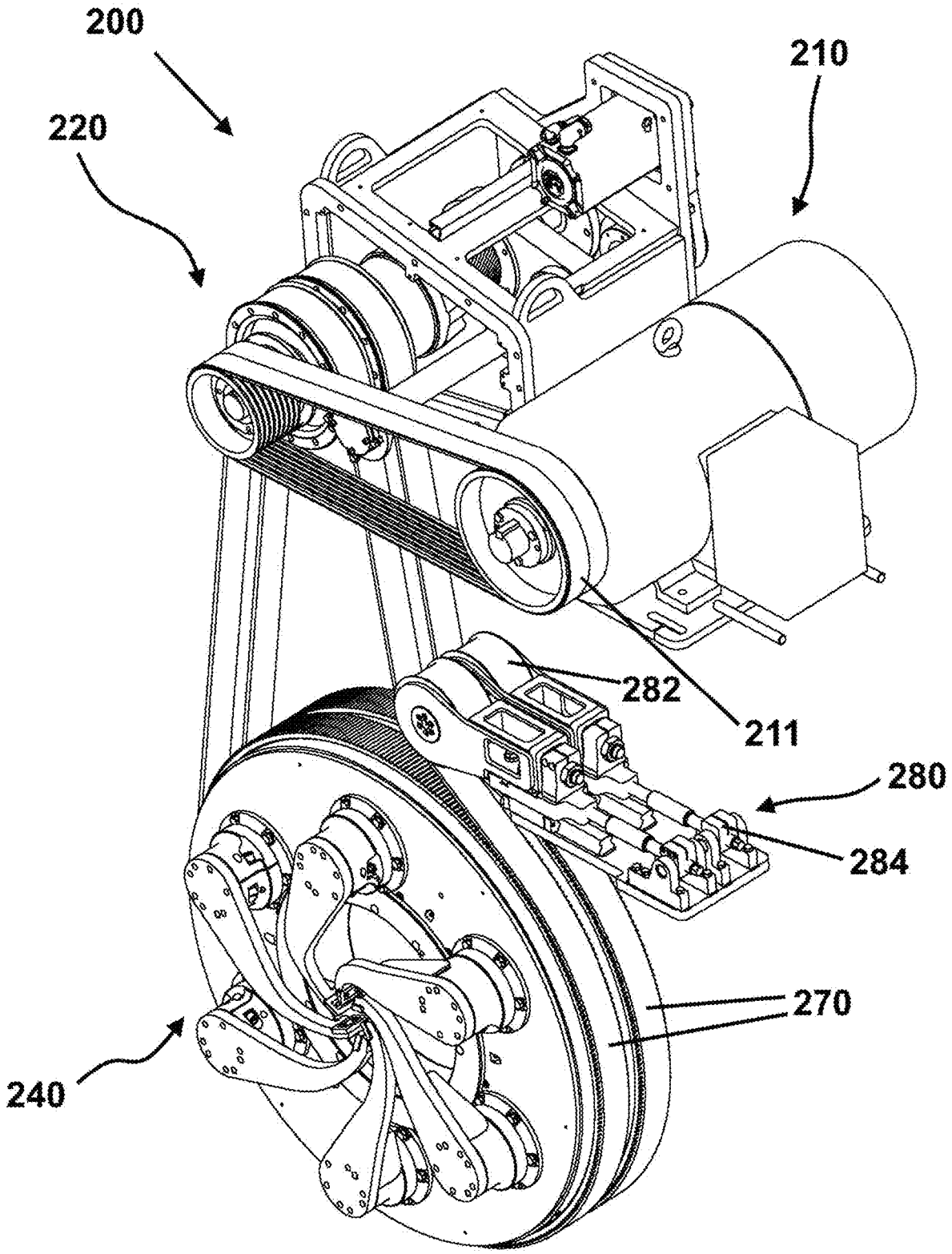
FIG. 10 is a right perspective view of a second embodiment of a phase shift debarker in accordance with the principles of the present invention.

Referring now to FIG. 10, a second embodiment of a phase shift debarker 200 is illustrated. The phase shift debarker 200 comprises a phase shifting mechanism 220 powered by a main motor 210 and connected to an operative assembly 240 by the mean of endless belt or timing belts 270. The main motor 210 is configured to control, by the mean of a belt 211, the movement of the phase shifting mechanism 220 which is adapted to control the movement of the operative assembly 240 by the mean of the timing belts 270. In such embodiment, the phase shift debarker 200 may further comprise a belt maintenance mechanism 280. In some embodiments, the interior portion of the belts 270 is toothed to engage with teeth present at the periphery of the ring.

The maintenance mechanism 280 may be adapted to release tension on the belt 270 (see FIG. 10). In the second embodiment, the maintenance mechanism 280 comprises one or more idling wheels 282 adapted to receive and be driven by the belt 270. The maintenance mechanism 280 may further comprise an activating system 284 adapted to either apply tension on the belt 270 when in operation mode or to release tension from the belt 270 when in maintenance mode. In the present embodiment, the activating system 284 is embodied as a pivoting member either applying (as shown in FIG. 10) or not applying when pivoted (not shown). One skilled in the art shall understand that any other tension control mechanism may be used to control the tension on one or more belts.

Figure 11:
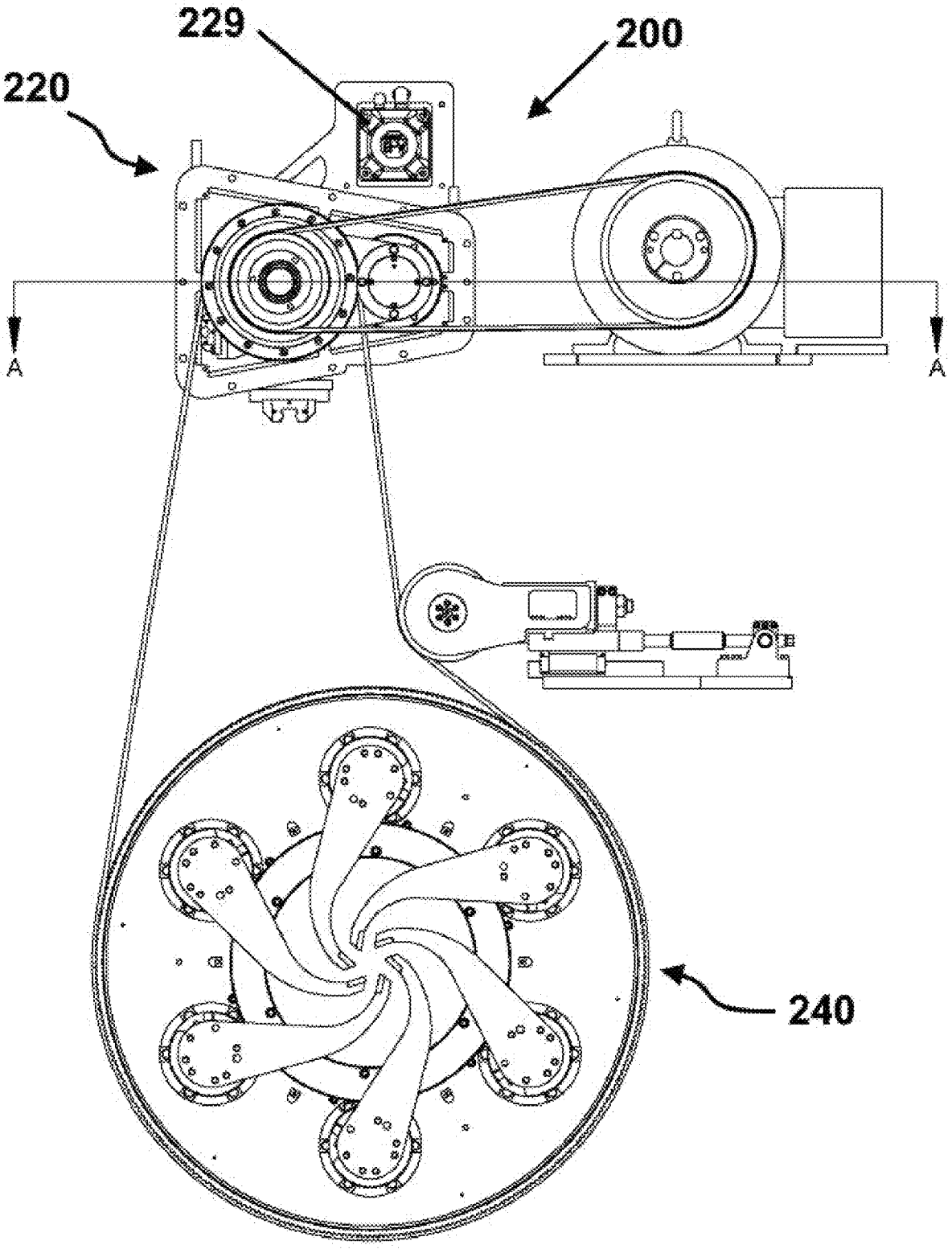
FIG. 11 is a front view of the phase shift debarker of FIG. 10.
Figure 12:
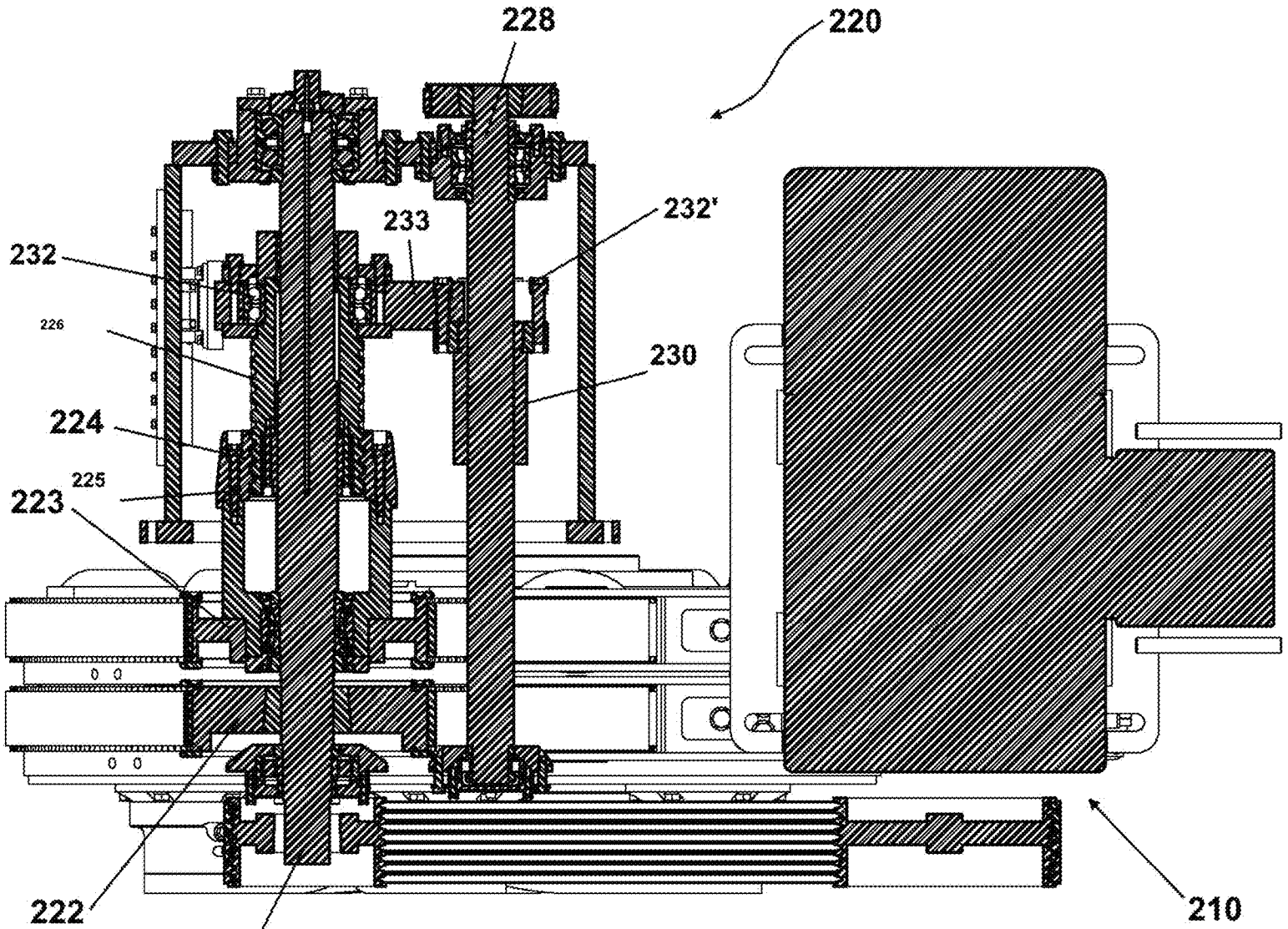
FIG. 12 is a top sectional A-A view of the phase shift debarker of FIG. 11.

Referring to FIGS. 11 and 12, the phase shifting mechanism 220 is illustrated in more details. Broadly, the phase shifting mechanism 220 allows varying the speed of one of the belts 270 or at least varying the speed of a pulley or a sprocket driving a belt or other drive mechanism. The phase shifting mechanism 220 comprises a first main shaft 221 driven by the motor or a driving mechanism 210. In the present embodiment, two pulleys or sprockets are mounted on the main shaft 221, a main ring sprocket 222 and an actuator ring sprocket 223. Understandably, the sprockets 222 and 223 may be mounted to the shaft using any known method. The actuator ring sprocket 223 comprises or is connected to a generally hollow portion 225 comprising a female moveably engaging section 224. In some embodiments, the moveably engaging female portion 224 is defined by helical splines.

The phase shifting mechanism 220 further comprises an actuating member, typically a ball screw 228 driven by a servomotor 229. A ball nut 230 is mounted on the ball screw 228.

The phase shifting mechanism 220 further comprises a cross-member 233 fixedly mounted to the first shaft at a first end 232 and slidably mounted to the ball screw 228 at a second end 232'. The cross-member 233 is typically made of rigid material. The second end 232' is adapted to be moved by the ball nut 230 upon rotation of the ball screw 228. When the ball screw 228 is rotating in one direction, the ball nut 230 engages with the cross-member 233, thus moving the cross-member in one direction along the ball screw 228. When the actuating shaft is rotating in a second direction, the ball screw disengages and the cross-member 233 moves in a second direction along the ball screw 228. The first end 232 further comprises a male moveably engaging section 226. When the cross-member slides toward the sprockets 221 and 221, the male moveably engaging section 226 engages or mate with the female moveably engaging section 224 of the hollow portion. In some embodiments, the moveably engaging male portion 226 is defined by helical splines or at least by a configuration mating the female portion 224. As the male and female sections 224 and 226 engage, the rotation of the actuating sprocket 223 is relative to the rotation of the helix of the splines.

In some embodiments, the ball screw 228 may have a right-handed (RH) pitch to the threads. When the ball screw is rotated counter clockwise, the ball nut 230 is pushed or moved. The cross member 233, which is mounted or attached to the ball nut 230, is moved in the direction of the main sprocket 222. When the male and female sections 224 and 226 are engaged in such direction (right to left in FIG. 12), the actuator sprocket 223 is rotated in a clockwise direction. In embodiments helical splines, the helix of the splines may have a left-handed pitch. When the rotation of the screw 228 is reversed, the ball screw pushes the cross member from left to right, then the rotation of the actuator sprocket would be counter clockwise.

As the actuating sprocket 223 direction is reversed momentarily, the belt exercises friction or engaging with teeth at the periphery of one of the rings of the operative assembly 240, thus reducing the rotational speed of the said ring.

The servomotor or controller 229 is configured or programmed to alternately rotate the ball screw 228 clockwise or counter clockwise or to stop rotation. Such sequence allows controlling the speed of the actuating sprocket 223 and/or reducing the speed of one of the rings of the operating assembly 240 to open or close the tool arms at the right diameter at the right time.

Figure 13:
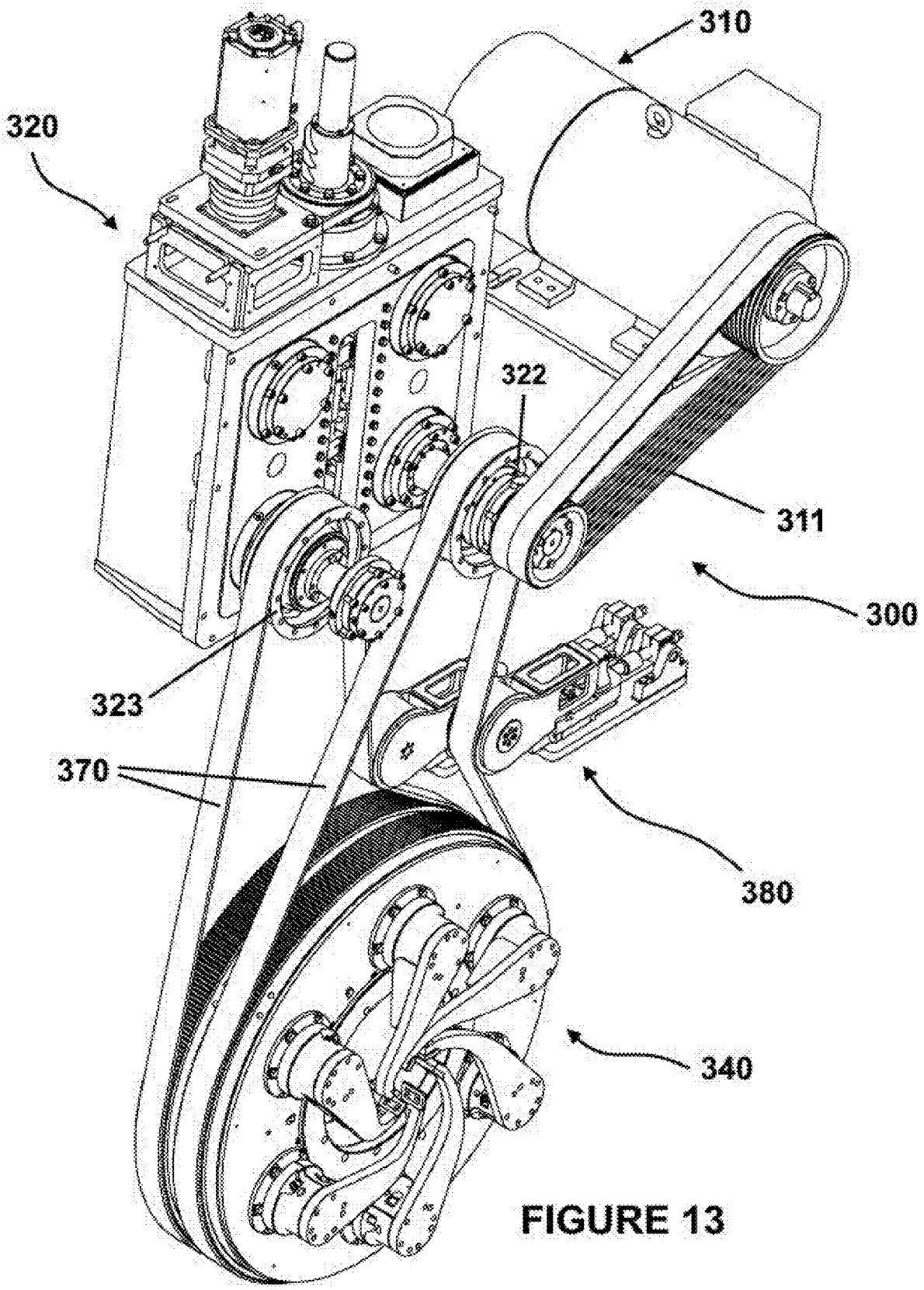
FIG. 13 is a left perspective view of a third embodiment of a phase shift debarker in accordance with the principles of the present invention.
Figure 14:
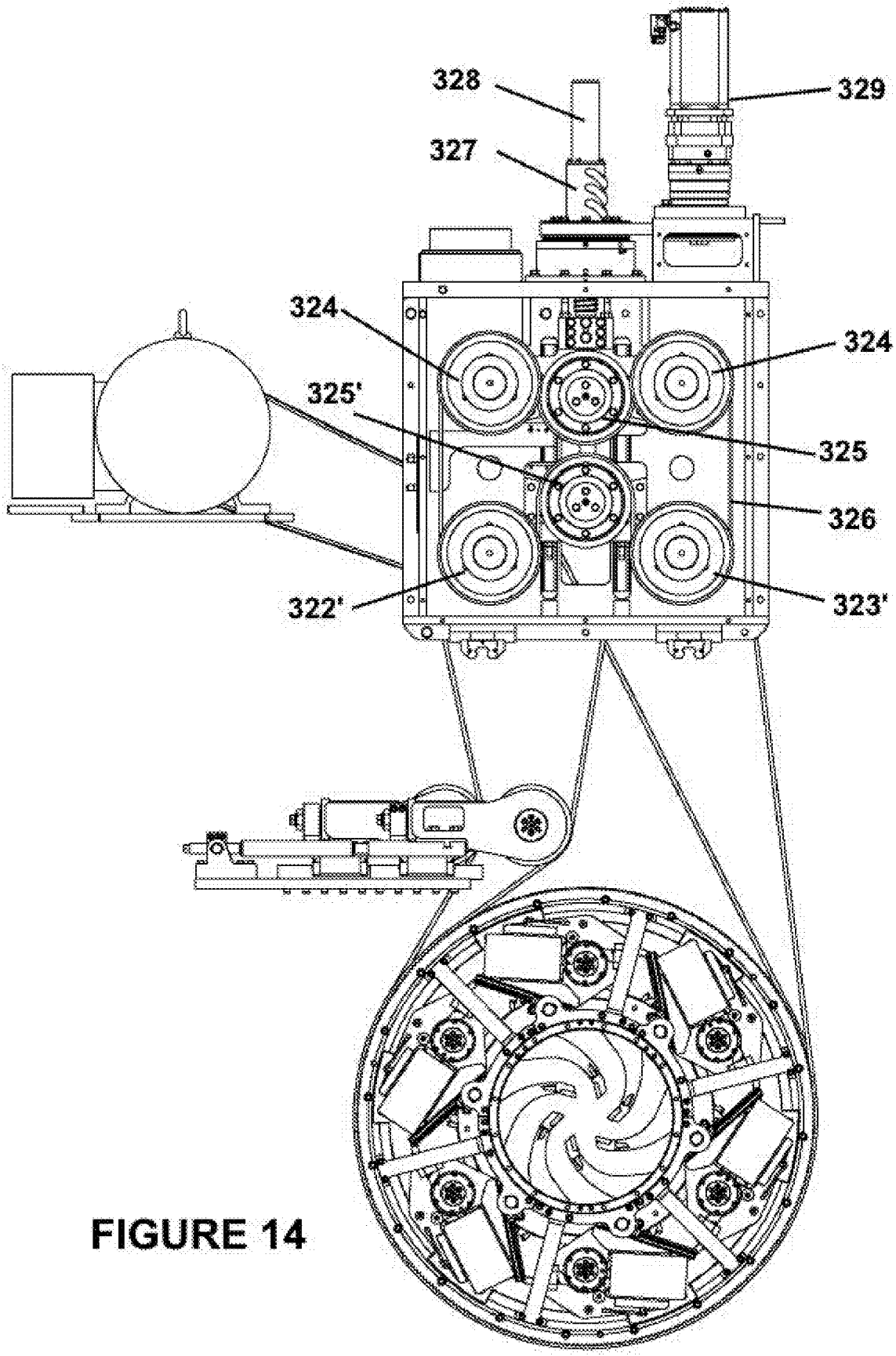
FIG. 14 is a rear view of the phase shift debarker of FIG. 13.

Referring now to FIGS. 13 and 14, a second embodiment of a phase shift debarker 300 is illustrated. As in other embodiments, the phase shift debarker 300 comprises a phase shifting mechanism 320 powered by a main motor 310 and connected to an operative assembly 340 by the mean of endless belt or timing belts 370. The main motor 310 is configured to control, by the mean of a belt 311 or other known driving mechanism, the movement of the phase shifting mechanism 320 which is adapted to control the movement of the operative assembly 340 by the mean of the timing belts 370. In such embodiment, the phase shift debarker 300 may further comprise a belt tension control mechanism 380.

Still referring to FIGS. 13 and 14, the phase shifting mechanism 320 is illustrated in details. Broadly, the phase shifting mechanism 320 allows varying the speed of one of the belts 370 or at least varying the speed of a pulley or a sprocket 323 driving a belt or other endless driving mechanism 370. The phase shifting mechanism 320 comprises a main sprocket or pulley 322 driving a belt 370 or other driving mechanism. In some embodiments, the same sprocket 322 is driven by the motor 310. The main sprocket 322 maintains a generally constant rotation speed provided by the motor 310.

Referring to FIG. 14, the other side of the phase shifting mechanism 320 is illustrated. The pulleys or sprockets 322 and 323 respectively provides rotational movement to pulleys or sprockets 322' and 323'. In such embodiment, the phase shifting mechanism 320 further comprises two idler wheels or pulleys 323 and two moving pulleys or idler wheels 325 and 325'. A belt or endless mean 326 surrounds the wheels 322', 323', 324, 325 and 325'.

The phase shifting mechanism 320 further comprises a vertical shaft 328 driven by the servomotor 329. The vertical shaft 328 comprises a ball screw 327. The phase shifting mechanism 320 further comprises a hollow portion adapted to receive and mate with the ball screw 327. As the servomotor drives the shaft 328, the ball screw 327 engages with the mating portion and produces vertical movement to the shaft 328. The two moving pulleys are mounted to the shaft 328 or to a member vertically moving with the shaft to move up or down. As the tension in the belt is constant and the speed of the main pulley 322' may not be changed, when the pulleys 325 and 325' move up or down, the rotation speed of the pulleys 323' and 324 varies. As pulley 323' ultimately drives the actuating belt 370, the rotation speed of the actuating belt 370 is increased or reduced (depending on movement).

Understandably, any other known phase shifting mechanism may be used or adapted be used with the present debarking system 100, 200, 300 as long as the phase shifting mechanism changes the speed of one of the two belts 170, 270 or 370 or driving mechanism while maintaining the speed of the other belt/mechanism constant.

Now referring to FIGS. 15 to 19, another embodiment of an operative assembly 240, 340 is illustrated. The present embodiment of the operative assembly 240 aims at improving spinning speed of the rings as the spinning does not require an air seal, which tends to create heat. As heat is created in previous systems, the speed of processing of the trunks must be reduced to avoid any overheating.

As in other embodiments, the operative assembly 240 comprises a main ring 241 and an actuator ring 242. The main ring 241 and the actuator ring 242 are pivotally mounted a rotation member, such as a shaft or mounting ring 271. Each ring 241 or 242 is adapted to independently rotate about the mounting ring 271. Understandably, any method to pivotally mount the rings 241 and 242 may be used, such as bearings or bushings. The actuator ring 242 may be mounted to the main ring 241 using guiding members 243. In a typical embodiment, the mounting ring 271 forms the aperture or the passage for the trunk.

In some embodiments, the actuator ring 242 may be configured to rotate by about 30 degrees with respect to the main ring 241.

Figure 15:
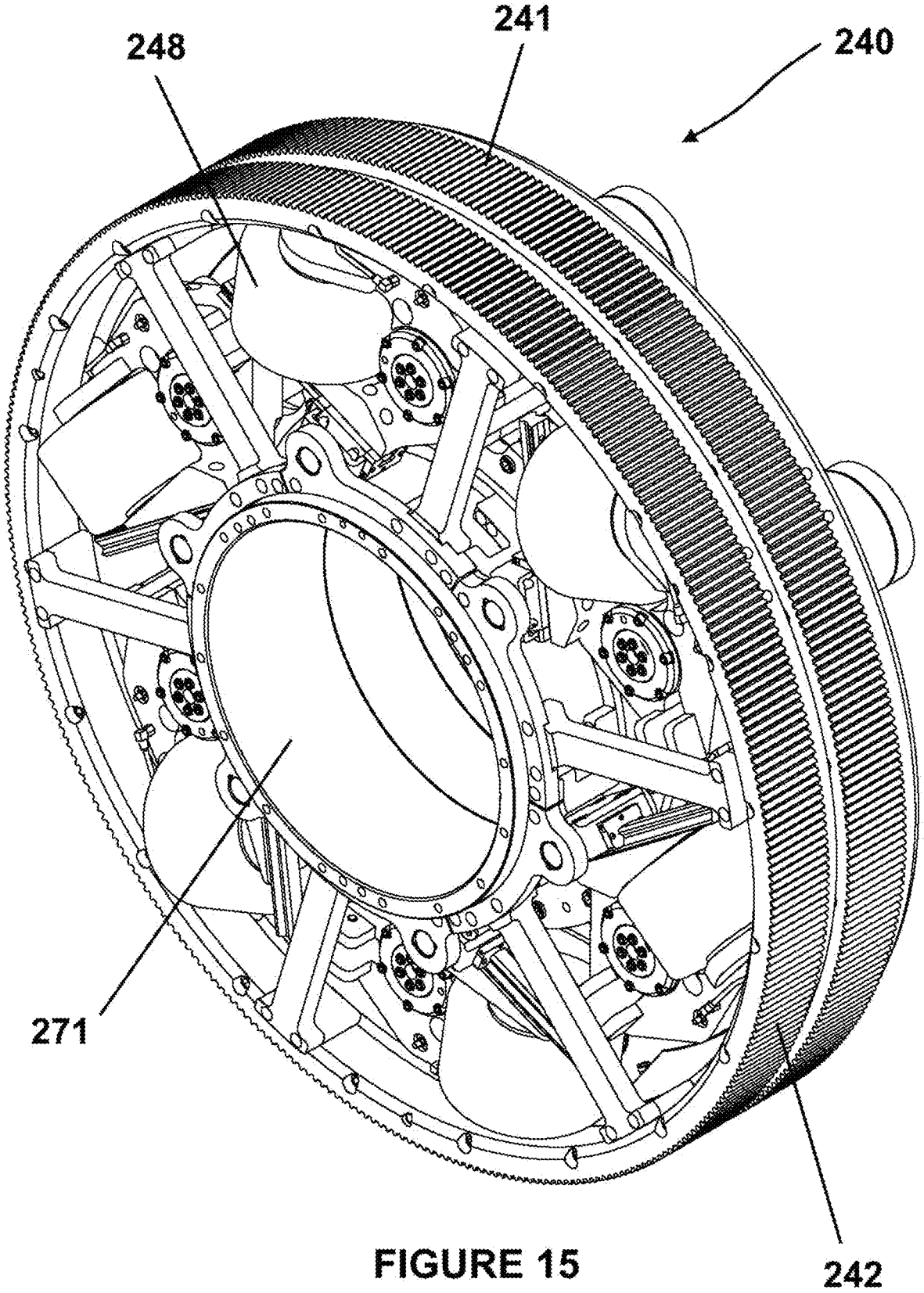
FIG. 15 is a rear perspective view of an operative assembly of a phase shift debarker in accordance with the principles of the present invention.
Figure 16:
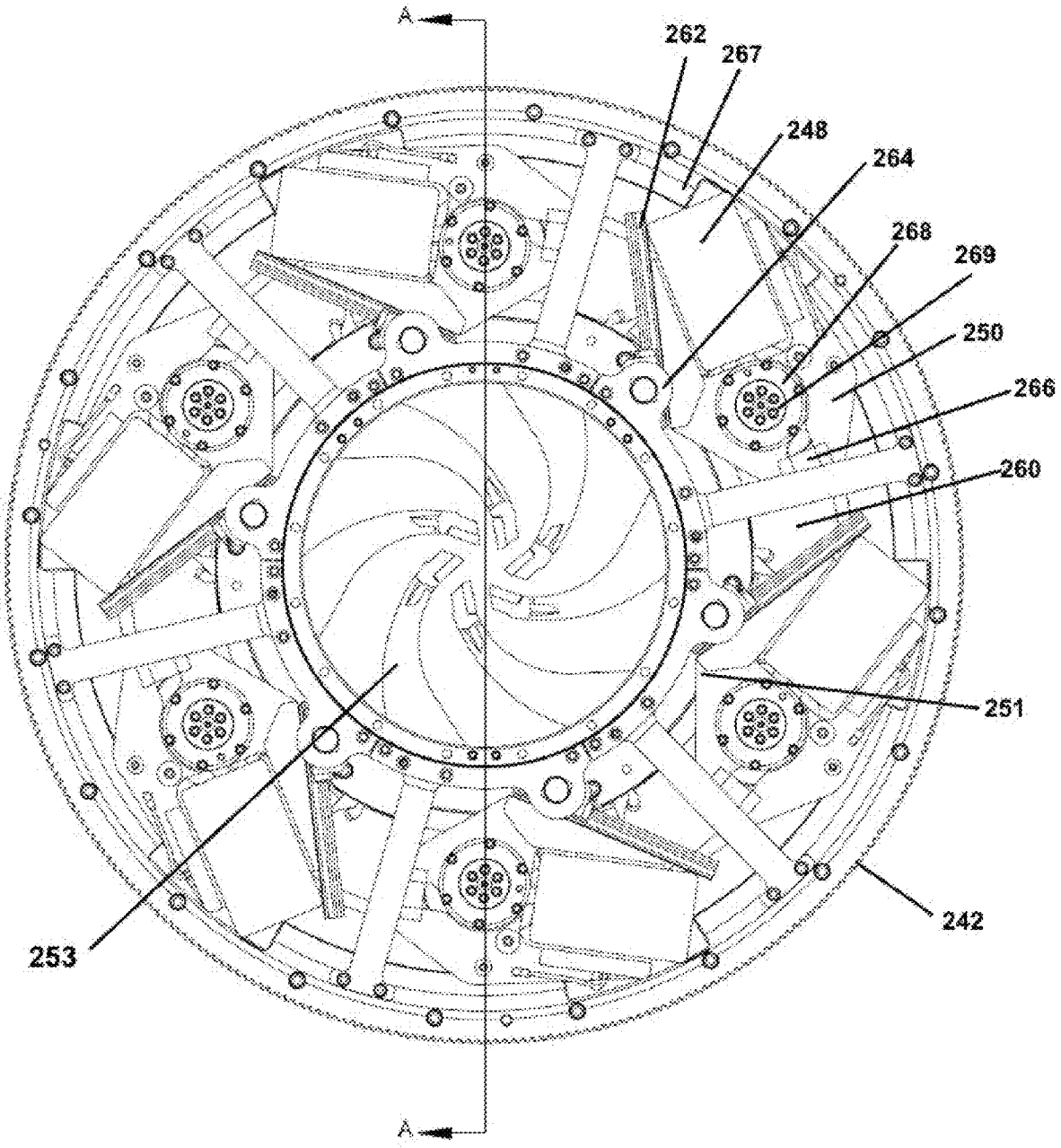
FIG. 16 is a rear plan view of the operative assembly of the FIG. 15 shown in close configuration.
Figure 17:
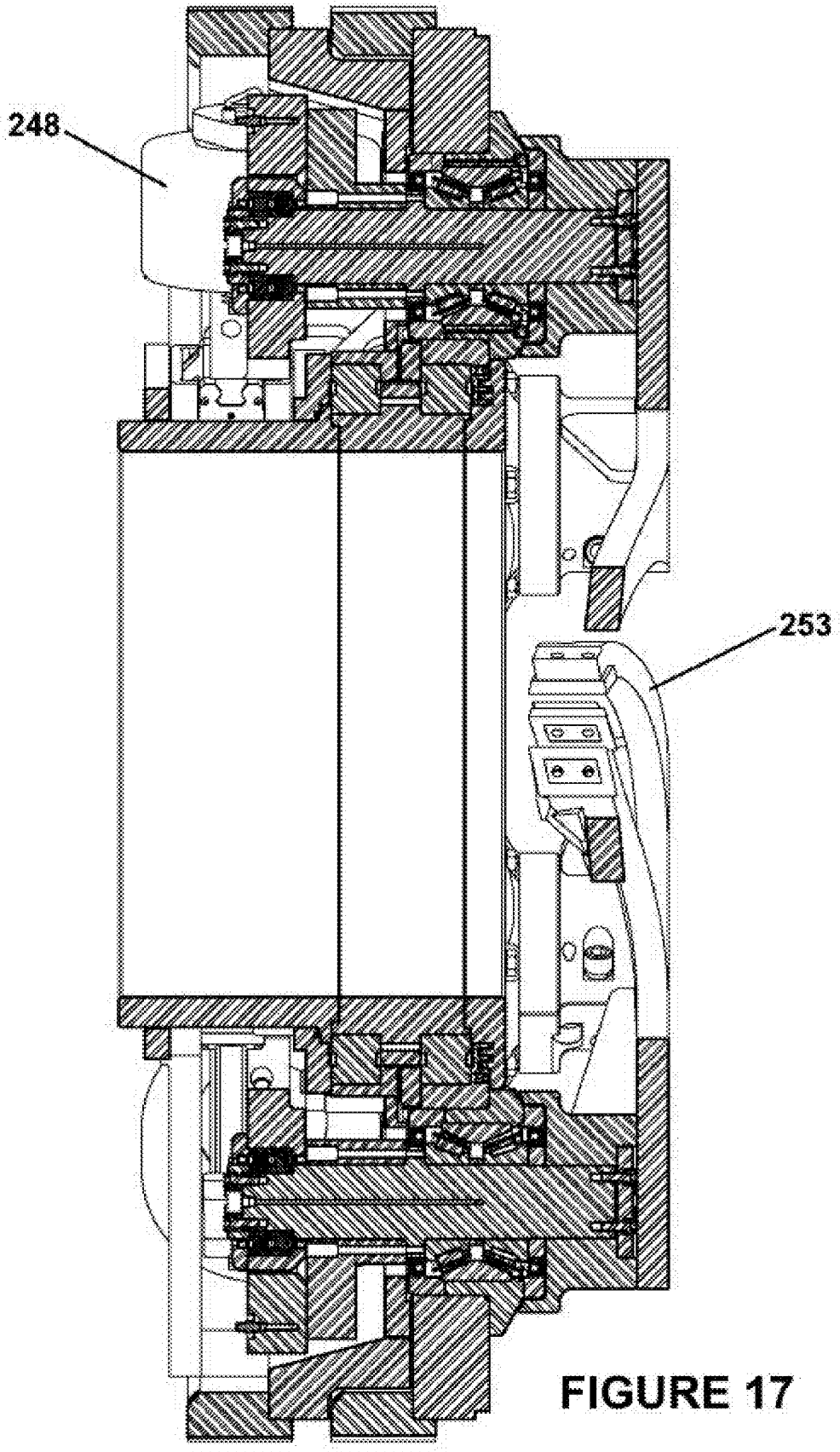
FIG. 17 is a sectional plan A-A view of the operative assembly debarker of FIG. 16.
Figure 18:
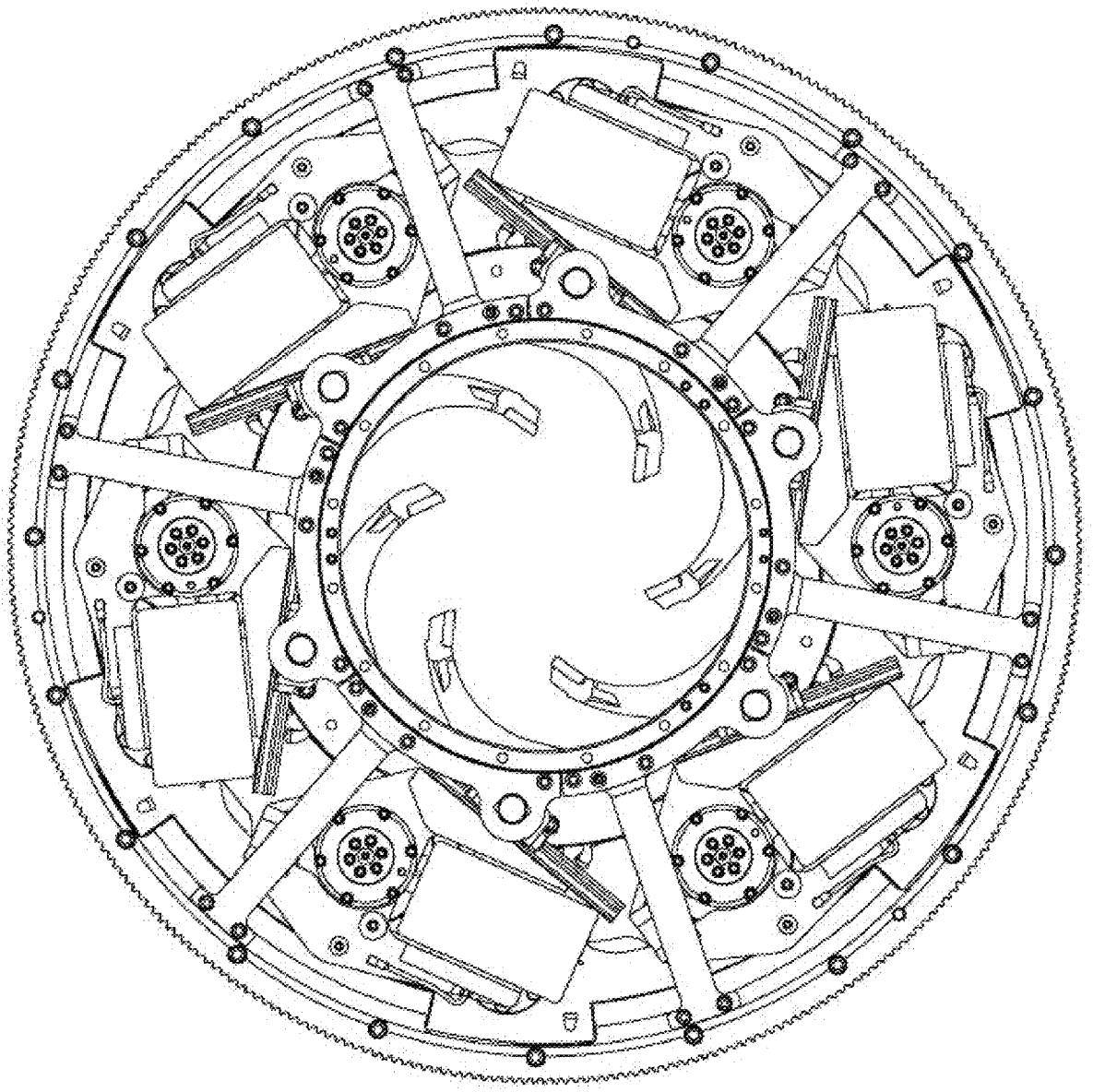
FIG. 18 is a rear plan view of the operative assembly of the FIG. 15 shown in open configuration.
Figure 19:
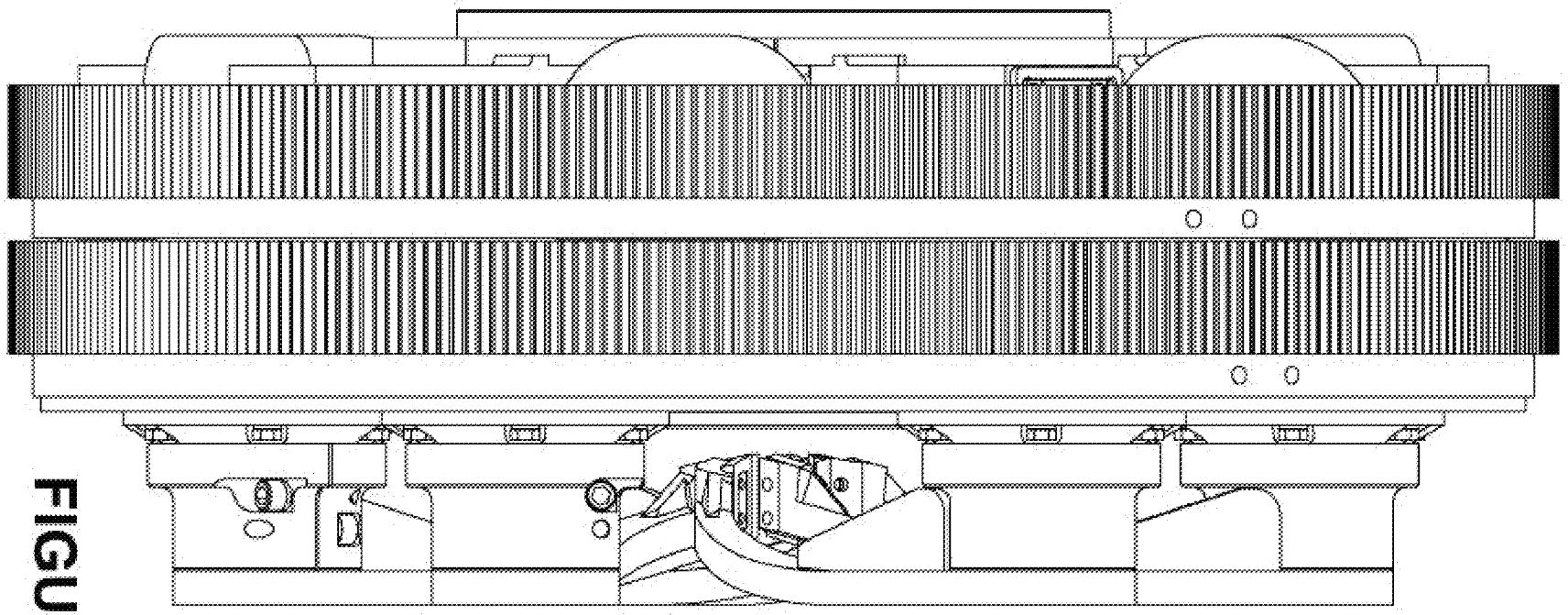
FIG. 19 is a left plan view of the operative assembly of the FIG. 15.

In the present embodiment, the main ring 241 comprises a plurality of tools arms 253 pivotally mounted at the periphery of the mounting aperture 271 (as an example, see FIG. 15). The tool arms 253 are commonly shaped to allow the non-pivoting extremity to move toward the center of the mounting aperture 271. Each tool arm 253 is mounted to a tension arm member 251. Typically, the pressure control mechanism 250 are equally spaced apart around the main ring 241 and actuating ring 242.

The pressure control mechanism 250 pivot with regard to the actuator ring 242 about the pivot point or mechanism 268 configured to receive a pivoting portion 269 of a tool arm 253. As the tool arm 253 is mounted to the same pivot point, the pivoting of the pressure control mechanism 250 also pivots the tool arm 253.

The actuating ring 242 comprises guiding apertures 260 adapted to guide each pressure control mechanism 250 along a generally radial path. The pressure control mechanism 250 further comprises a pre-charged air spring 248 mounted to the pressure control mechanism 250. The pressure control mechanism 250 may further comprise an angled portion 251. Understandably, the guiding apertures 260 may have any shape required to guide the movement of the pressure control mechanism 250.

The pre-charged air spring 248 is typically embodied as an air bag. The air spring is typically set at a predetermined initial pressure. Such initial pressure is typically set during maintenance or at predetermined intervals. It should be understood that in a preferred embodiment, the volume of air present in the air spring 248 remains the same. As pressure remains the same, the compression and expansion of the air spring 248 does not create additional heat to the system. Thus, the logs may be debarked at higher speed than conventional systems which tends to reduce traveling speed of the logs to avoid overheating events.

As the tool arms are ultimately connected to the pressure control mechanism 250, the pressure of the tip of the tool arm on the wood is a function of the pressure of the air spring 248. The air spring 248 typically allows the force of the tool arm to be maintained at a predetermined value at the periphery of the trunk. Also, as force at the tip of the tool arms 253 increases as a function of the compression of the air spring 248, the diameter of the opening formed by the tool arms 253 is calculated as a function of the initial pressure vs the compressed pressure of the air spring 248 and of the rotational speed of the rings 241/242.

The actuating ring 242 further comprises guiding members 262. Each guiding member 262 is mounted to pressure control mechanism 250. The guiding member 262 is adapted to move and pivot about the pivot point 264. The shape and mechanism of the guiding member 262 may be adapted according to the desired pivoting movement of the tool arms 253. In a preferred embodiment, the guiding member 262 is slidably mounted on a rail and is pivotally mounted to the pivot point 264. Broadly, the sliding movement of the pressure control mechanism 250 induced by the change in speed of the actuating ring 242 is converted to a pivoting movement of the tool arms 253 when pivoting at the pivot point 268.

When the speed of the actuating ring 242 is changed or varied by the phase shifting mechanism 220, the actuating ring 242 rotates with regard to the main ring 241. Such rotation movement create movement in the pressure control mechanism 250. In a typical embodiment, the pressure control mechanism 250 moves with regard to the actuating ring 242. The actuating ring may further comprise an abutting portion 267. In some embodiment, another abutting portion 266 is adapted to stop the movement of the pressure control mechanism 250. The compression in the air spring 248 maintains a constant pressure on the tip of the tool arms 253.

The debarking system 100, 200, 300 may further comprise a trunk diameter scanning system (not shown). The scanning system is configured to scan the trunk or log to be debarked to calculate the diameter of the trunk. The calculated diameter data is sent to a controller, or to the servomotor 129, 229, 329, which is configured to calculate the required opening of the tools arms 153, 253 to debark the trunk. In embodiments having a controller, the controller is further configured to control the servomotor 129, 229, 329. As explained above, the servomotor 129, 229, 329 controls the speed of the actuating ring 142, 242 using the phase shifter mechanism 120, 220, 320 to open/close the tool arms 153, 253 at the calculated diameter.

In some embodiments, each trunk may be scanned at predetermined frequency to adapt to different diameters of the same trunk. In such embodiments, the phase shifter mechanism 120, 220, 320 changes the diameter of the opening of the tool arms 153, 253 to adapt to the shape or to variation of diameter of the trunk as it is traveling in the debarking system 100, 200, 300.

Referring now to FIGS. 1 to 9, a method for debarking one or more logs is illustrated. The method comprises calculating the diameter of the log to be debarked. The method further comprises adapting the diameter of the aperture formed by the tool arms 153, 253 based on the diameter of the log to be debarked.

The method may further comprise introducing a log to the debarking system 100, 200 or 300. Based on the diameter of the trunk, the debarking system adjusts the speeds of the actuating ring 142, 242 to form an aperture with the tool arms adapted to the diameter of the trunk. The method may comprise rotating the main ring 141, 241 and the actuator ring 142, 242 at the same speed or at different speeds. When rotating at different speeds, the tools arms 153, 253 are rotating to form an aperture having a diameter adapted with the shape of the trunk.

In some embodiment, the press control mechanisms 150 are in a released position and the tool arms 153 are being firmly closed when the speed of both rings 141, 241 and 142, 242 is the same.

The method may further comprise initiating an operative mode of the servomotor 129 by detecting the presence of the log by at least one sensor or other means. The servomotor 129 drives the rotation of a ball screw 128, 228, 328 which actuates the sliding movement of a ball nut 130, 230, 327.

In some embodiments, the method may further comprises actuating the sliding movement of the male component 126, 226 over the surface of the main shaft 121, 221 in a way that the male component 126, 226 engages the female component 124, 224, resulting in the rotation of the actuator ring sprocket 123, 223 with respect to the main shaft 121, 221 (see FIGS. 2-3). The actuator ring sprocket 123, 223 and the main ring sprocket 122, 222 are then rotating at the same speed with a shift phase.

In at least one embodiment, the method may further comprise slidably rotating the guiding members 143 of the actuator ring over the curved rails 144 of the main ring 141 as a result of the phase shifting between both sprockets 122 and 123. This slidable rotation movement induces a rotation of the actuator ring 142 with respect to the main ring 141.

In some embodiments, the method further comprises calculating the opening or passage diameter formed by the tool arms 253 as a function of the diameter of the scanned trunk and of the speed of rotation of the rings in order to provide a predetermined force on the periphery of the trunk by the tip of the tool arm. Understandably, the force on the tool arms 253 is thus a function of the compression level of the air spring 248 versus the initial pressure inserted in the air spring 248.

In some other embodiments, the debarker may be configured to completely retract or open all the tool arms when the logs feeding system stops. Such complete opening typically eases dislodging any trunk present in the debarker.

The method may further comprise rotating the pressure control mechanisms 150 with respect to the main ring 141 by the mean of the gear segments 145 and 152 (see FIG. 8).

The method may further comprise compressing the pre-charged springs to move apart the tool arms 153 in order to define circumference corresponding to the diameter of the log to be debarked (See FIG. 8).

Understandably, any other mechanical configuration of a phase shifting mechanism may be used to create a shift phase between the rings of the operative assembly of the phase shifting debarker.

Understandably, any other device may be used to create a shift phase between the rings of the operative assembly of the phase shifting debarker.

While illustrative and presently preferred embodiments of the invention have been described in detail hereinabove, it is to be understood that the inventive concepts may be otherwise variously embodied and employed and that the appended claims are intended to be construed to include such variations except insofar as limited by the prior art.

The invention claimed is:

1. A phase shift log debarker, the debarker comprising:
an operative assembly comprising:
an aperture adapted to receive a log;
a first ring rotatably mounted to a second ring about a common axis;
tool arms adapted to move in and out of the aperture;
a driver inducing rotation of the first ring; and
a phase shifter driven by the driver and inducing rotation of the second ring, the phase shifter being adapted to shift a position of the second ring at a shift angle relative to the first ring, the shift angle being between a minimum angle and a maximum angle and being a function of a measured diameter of the log;
wherein the shift of position of the second ring to the shift angle triggers the movement of the tool arms.

2. The phase shift log debarker of claim 1, the debarker further comprising first and second endless bands, the first and second endless bands each driving one of the rings, the first endless band being driven by the driver and the second endless band being driven by the phase shifter.

3. The phase shift log debarker of claim 2, the first and second endless bands respectively surrounding the periphery of the first and second rings.

4. The phase shift log debarker of claim 2, the first and second endless bands being belts.

5. The phase shift log debarker of claim 2, the periphery of the rings being toothed and the first and second endless bands being toothed to engage with the toothed periphery of the rings.

6. The phase shift log debarker of claim 4, the phase shifter being adapted to momentarily change speed of rotation of the second endless band, a momentary speed change of the second endless band shifting the position of the second ring at the shift angle relative to the second ring.

7. The phase shift log debarker of claim 6, the phase shifter further comprising two wheels driven by the driver, each wheel driving one of the first or second rings with the first and second endless bands, the phase shifter being adapted to reverse the direction of rotation or to stop the rotation of the wheel driving the second ring.

8. The phase shift log debarker of claim 6, the phase shifter further comprising a servomotor configured to reverse the direction of rotation or to stop the rotation of the second endless band.

9. The phase shift log debarker of claim 1, the second ring further comprising a plurality of pressure control mechanisms, each pressure control mechanism being mounted to each tool arm, the pressure control mechanisms being adapted to move with regard to the first ring.

10. The phase shift log debarker of claim 9, the pressure control mechanisms being equally and radially spaced apart within the second ring.

11. The phase shift log debarker of claim 9, the first ring further comprising a guiding aperture for each pressure control mechanism, each guiding aperture being adapted to guide the pressure control mechanism along a predetermined radial path.

12. The phase shift log debarker of claim 9, each pressure control mechanism being mounted to an air spring filled with a predetermined volume of gas, the air-spring being adapted to maintain pressure on the tool arms.

13. The phase shift log debarker of claim 12, the positioning of the second ring at the shift angle triggering compression of the air-spring when the measured diameter of the log to be debarked is higher than a diameter of a passage formed by the tool arms in the aperture.

14. The phase shift log debarker of claim 12, a force applied by the tool arms on the periphery of the log to be debarked being a function of a compression level of the air spring, the compression level of the air spring being a function of the measured diameter of the log.

15. The phase shift log debarker of claim 9, the first ring further comprising a guiding member for each pressure control mechanism, each guiding member being pivotally and slidably mounted to the first ring and being mounted to one of the pressure control mechanisms.

16. The phase shift debarker apparatus of claim 1, wherein the difference between the minimum and maximum angles is less than 30 degrees.

17. The phase shift log debarker of claim 1, wherein the driver and the phase shifter respectively rotate the first and second rings at the same speed.

18. The phase shift log debarker of claim 1, wherein extremities of the tool arms create a passage within the aperture in a move-in position, the size of the passage varying as a function of the variation of the shift angle between the second ring relative to the first ring.

19. The phase shift log debarker of claim 1, wherein the shift of position of the second ring at the shift angle relative to the first ring triggers moving extremities of the tool arms to form—an opening having a dimension being a function of the shift angle, and wherein the positioning of the second ring at the minimum angle relative to the first ring triggers moving the tool arms out of the aperture.

20. The phase shift log debarker of claim 1 further comprising a log measuring device in communication with the phase shifter for measuring the diameter of the log.

21. The phase shift log debarker of claim 20, the log measuring device being a scanner.

22. The phase shift log debarker of claim 1, wherein the phase shifter comprises:

a servomotor;

a moving member driven by the servomotor; and two idling wheels pivotally mounted to the moving member driven by the driver; the servomotor momentarily displacing the moving member, the displacement of the moving member varying the speed of rotation of the second ring.

* * * * *